US009353552B1

(12) United States Patent
Kelsch et al.

(10) Patent No.: US 9,353,552 B1
(45) Date of Patent: May 31, 2016

(54) ANTI-THEFT DEVICE FOR MERCHANDISE DISPLAYS

(71) Applicants: Vanguard Products Group, Inc., Oldsmar, FL (US); Christopher A. Kelsch, Tarpon Springs, FL (US)

(72) Inventors: Christopher A. Kelsch, Tarpon Springs, FL (US); John N. Figh, Jr., Oldsmar, FL (US); Lucas P. Swartwood, Tampa, FL (US); Bruno M. L. Telles, Tampa, FL (US)

(73) Assignee: Vanguard Products Group, Inc., Oldsmar, FL (US)

( * ) Notice: Subject to any disclaimer, the term of this patent is extended or adjusted under 35 U.S.C. 154(b) by 295 days.

(21) Appl. No.: 14/192,392

(22) Filed: Feb. 27, 2014

Related U.S. Application Data

(60) Provisional application No. 61/770,020, filed on Feb. 27, 2013.

(51) Int. Cl.
*E05B 65/00* (2006.01)
*E05B 73/00* (2006.01)

(52) U.S. Cl.
CPC ..... *E05B 65/00* (2013.01); *E05B 73/0017* (2013.01)

(58) Field of Classification Search
CPC . E05B 65/00; E05B 73/0017; E05B 73/0052; E05B 73/0011; E05B 73/0082; E05B 73/0029; Y10T 70/5004; Y10T 70/40; Y10T 70/5009; Y10T 70/7904; Y10T 24/44923; Y10T 70/50; Y10T 70/8216
USPC ..... 70/57.1, 58, 370
See application file for complete search history.

(56) References Cited

U.S. PATENT DOCUMENTS 2,948,141 A * 8/1960 Vahlstrom ..... E05B 9/084 248/27.1
3,964,280 A * 6/1976 Kelton ..... E05B 57/00 70/237
5,372,020 A * 12/1994 Stoltz ..... E05B 73/0017 70/57.1
5,410,899 A * 5/1995 McConnell ..... E05B 9/08 403/257
5,588,315 A * 12/1996 Holmgren ..... A47F 7/0246 206/1.5

(Continued)

*Primary Examiner* — Suzanne Barrett
(74) *Attorney, Agent, or Firm* — Andriy Lytvyn; Smith & Hopen, P.A.

(57) ABSTRACT

The anti-theft device for merchandise displays. An electronic sensor fixedly attaches to a merchandise item. A sensor receptacle adapted to receive the electronic sensor is integrated into a base of the device. The sensor receptacle contains apertures and the sensor contains slots that align when the sensor is placed within the receptacle. A clip is in a sliding engagement with the base. The clip slides between a locked and an unlocked positions. The clip includes one or more outwardly extending fingers that protrude through the slots of the sensor receptacle and engage the slots of the sensor when the clip is in the locked position. A locking member engages the clip preventing the clip from retracting into the unlocked position. A magnet key is used for disengaging the locking member from the clip allowing the clip to slide into its unlocked position, thereby releasing the sensor from the sensor receptacle.

29 Claims, 8 Drawing Sheets

(56) References Cited

U.S. PATENT DOCUMENTS 5,636,540 A * 6/1997 Myers ..... E05B 9/084 24/458
5,768,922 A * 6/1998 Lax ..... E05B 73/0023 206/387.1
5,979,196 A * 11/1999 Vanmoor ..... E05B 73/0017 24/460
6,191,692 B1 * 2/2001 Stoltz ..... E05B 73/0017 340/572.1
6,374,648 B1 * 4/2002 Mitsuyama ..... E05B 73/0023 206/308.1
6,430,976 B1 * 8/2002 Mitsuyama ..... E05B 73/0023 206/1.5
6,472,989 B2 * 10/2002 Roy, Jr. ..... E05B 73/0017 340/551
6,568,229 B1 * 5/2003 Heinrich ..... E05B 17/04 70/367
6,595,033 B1 * 7/2003 Hara ..... E05B 9/084 70/370
6,672,455 B2 * 1/2004 Belden, Jr. ..... E05B 17/0662 206/1.5
7,221,274 B2 * 5/2007 Fawcett ..... A47G 29/10 340/568.2
7,320,235 B2 * 1/2008 Belden, Jr. ..... E05B 73/0023 206/1.5
7,522,047 B2 * 4/2009 Belden, Jr. ..... A47F 5/12 248/133
7,536,884 B2 * 5/2009 Ho ..... E05B 73/0017 24/704.1
7,581,419 B2 * 9/2009 Belden, Jr. ..... E05B 73/0023 206/1.5
8,051,686 B2 * 11/2011 Garner ..... E05B 17/2015 340/572.1
8,640,508 B2 * 2/2014 Maddox ..... E05B 73/0023 206/1.5
8,698,617 B2 * 4/2014 Henson ..... G06F 1/1626 340/539.1
8,698,632 B2 * 4/2014 Zinner ..... E05B 73/0017 340/571
8,733,138 B2 * 5/2014 Favier ..... E05B 73/0017 70/19
8,752,406 B2 * 6/2014 Shute ..... E05B 73/0017 206/6.1
8,847,762 B2 * 9/2014 Lian ..... E05B 73/0017 340/10.1
8,881,560 B2 * 11/2014 Avganim ..... E05B 73/0082 70/158
2002/0158512 A1 * 10/2002 Mizutani ..... B60K 37/02 307/9.1
2003/0222780 A1 * 12/2003 Sayegh ..... E05B 73/0017 340/572.9
2004/0123311 A1 * 6/2004 Farrar ..... E05B 73/0023 720/728
2005/0073413 A1 4/2005 Sedon et al.
2006/0021394 A1 2/2006 Belden et al.
2006/0097872 A1 * 5/2006 Ho ..... E05B 73/0017 340/572.1
2006/0137408 A1 * 6/2006 Maddox ..... E05B 73/0023 70/57.1
2006/0145866 A1 7/2006 Marsilio et al.
2006/0170559 A1 8/2006 Marsilio et al.
2007/0152835 A1 7/2007 Marsilio et al.
2008/0024300 A1 1/2008 Fawcett et al.
2008/0169924 A1 7/2008 Belden et al.
2008/0209960 A1 9/2008 Nagelski et al.
2009/0139279 A1 * 6/2009 Garner ..... E05B 17/2015 70/57.1
2010/0175438 A1 7/2010 Sankey et al.
2010/0223965 A1 9/2010 Richardson et al.
2011/0100073 A1 5/2011 Johnston et al.
2011/0283754 A1 11/2011 Ezzo et al.
2012/0000254 A1 * 1/2012 Zhao ..... E05B 73/0017 70/58
2012/0144882 A1 * 6/2012 Shute ..... E05B 73/0017 70/14
2012/0217314 A1 * 8/2012 Vathy ..... E05B 73/0017 235/492
2012/0326871 A1 * 12/2012 Lian ..... E05B 73/0017 340/572.1

* cited by examiner

ANTI-THEFT DEVICE FOR MERCHANDISE DISPLAYS

PRIORITY CLAIM

This patent application claims priority to U.S. Provisional Patent Application Ser. No. 61/770,020 filed Feb. 27, 2013 entitled "Anti-theft Device for Merchandise Displays."

BACKGROUND OF THE INVENTION

1. Field of the Invention

This invention relates to merchandise anti-theft devices. More specifically, it relates to a merchandise display device with an anti-theft locking mechanism preventing unauthorized removal of secured merchandise.

2. Brief Description of the Related Art

Retailers often prefer to demonstrate their merchandise to consumers by allowing the consumers to touch, inspect, and interact with the products at a display counter. Many merchandise items, especially portable electronic devices, are relatively expensive and, therefore, are under a serious threat of theft. Retailers often face a dilemma of wanting to attract customers and increase sales by interactively displaying their merchandise, while, at the same time, protecting themselves from potential losses associated with theft.

A variety of anti-theft devices exist in the market that address this problem by offering a wide array of solutions for securing merchandise items against unauthorized removal. Many currently available solutions involve steel cables, locks, clamps, grips, casings, and other obtrusive and unattractive mechanisms. Customers may be deterred from interacting with products that have bulky intimidating security devices attached to them. Moreover, excessive security measures may ruin the overall ambience of a retail store driving customers away and reducing sales. Accordingly, there exists an unresolved need for a simple, discrete, and effective anti-theft device for selectively locking a merchandise item to a display counter.

SUMMARY OF THE INVENTION

The long-standing but heretofore unfulfilled need for a discrete and effective anti-theft device for merchandise retail displays is now met by a new, useful, and nonobvious invention.

In one embodiment, the device includes a base plate into which a sensor receptacle is integrated. The base plate integrates into, or attaches underneath, a retail merchandise display counter. An electronic sensor fixedly attaches to a merchandise item being displayed. An adhesive may be used to attach the top surface of the sensor to the merchandise item. The sensor receptacle is adapted to receive the electronic sensor. The sensor receptacle contains apertures and the sensor contains corresponding slots. The slots of the sensor align with the apertures of the sensor receptacle when the sensor is positioned within the receptacle.

The device further includes a clip in a sliding engagement with the base plate. The clip slides linearly between a locked position and an unlocked position. The clip may contain one or more outwardly extending fingers. In the locked position, the fingers protrude through the apertures of the receptacle and enter the slots of the sensor, thereby securing the sensor within the receptacle. In the unlocked position, the clip is retracted away from the receptacle disengaging the slots of the sensor, thereby releasing it from the receptacle. In an embodiment, the clip may be biased towards the unlocked position.

The invention also includes a locking mechanism for retaining the clip in its locked position. When the clip is in the locked position, the locking member engages the clip preventing it from sliding into an unlocked position. In an embodiment, the locking mechanism may include a biasing element to bias the locking member toward a position in which it engages the clip.

A dipole magnet key is used for unlocking the device. The magnet key attracts the locking member disengaging it from the clip, thereby allowing the clip to retract away from the sensor receptacle, thus releasing the sensor. In an embodiment where the locking member is biased, the magnetic force of the key overcomes the biasing force to disengage the locking member.

In an embodiment, the magnet key is utilized for pushing the clip into its locked position. The device may contain two keyholes: one for locking the sensor and one for releasing it. The same key may be used for both operations of locking and unlocking the device.

In an embodiment, the clip has a protruding end that extends beyond the base plate. The protruding end is pushed in to slide the clip into its locked position. The device is unlocked using the magnet key.

DESCRIPTION OF THE DRAWINGS

For a fuller understanding of the invention, reference should be made to the following detailed description, taken in connection with the accompanying drawings, in which.

DETAILED DESCRIPTION OF THE PREFERRED EMBODIMENT

In the following detailed description of the preferred embodiment, reference is made to the accompanying drawings, which form a part hereof, and within which specific embodiments are shown by way of illustration by which the invention may be practiced. It is to be understood that other embodiments may be utilized and structural changes may be made without departing from the scope of the invention.

Figure 1A:
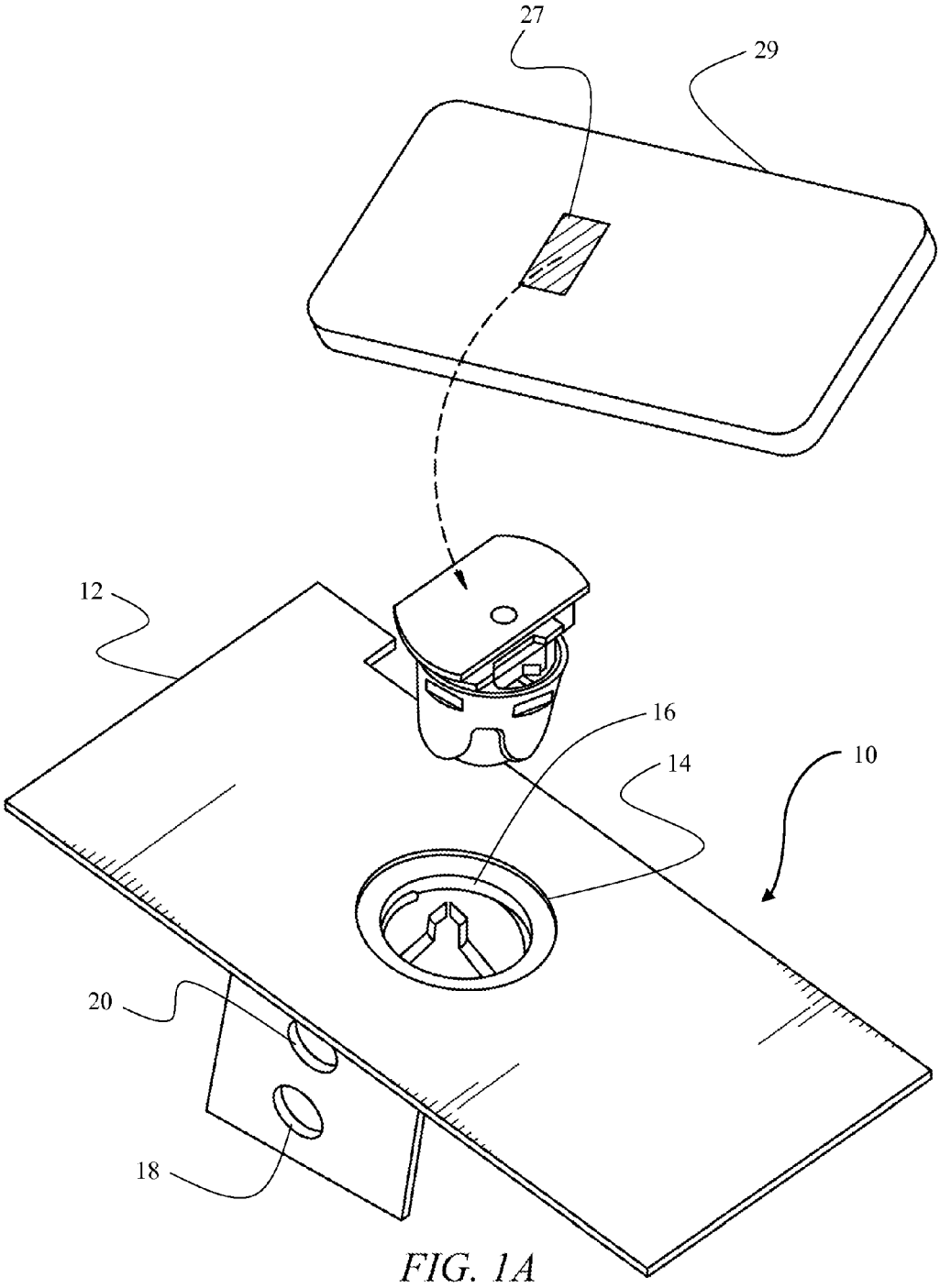
FIG. 1A is a perspective view of the display counter with the security sensor being removed from the anti-theft security base.
Figure 1B:
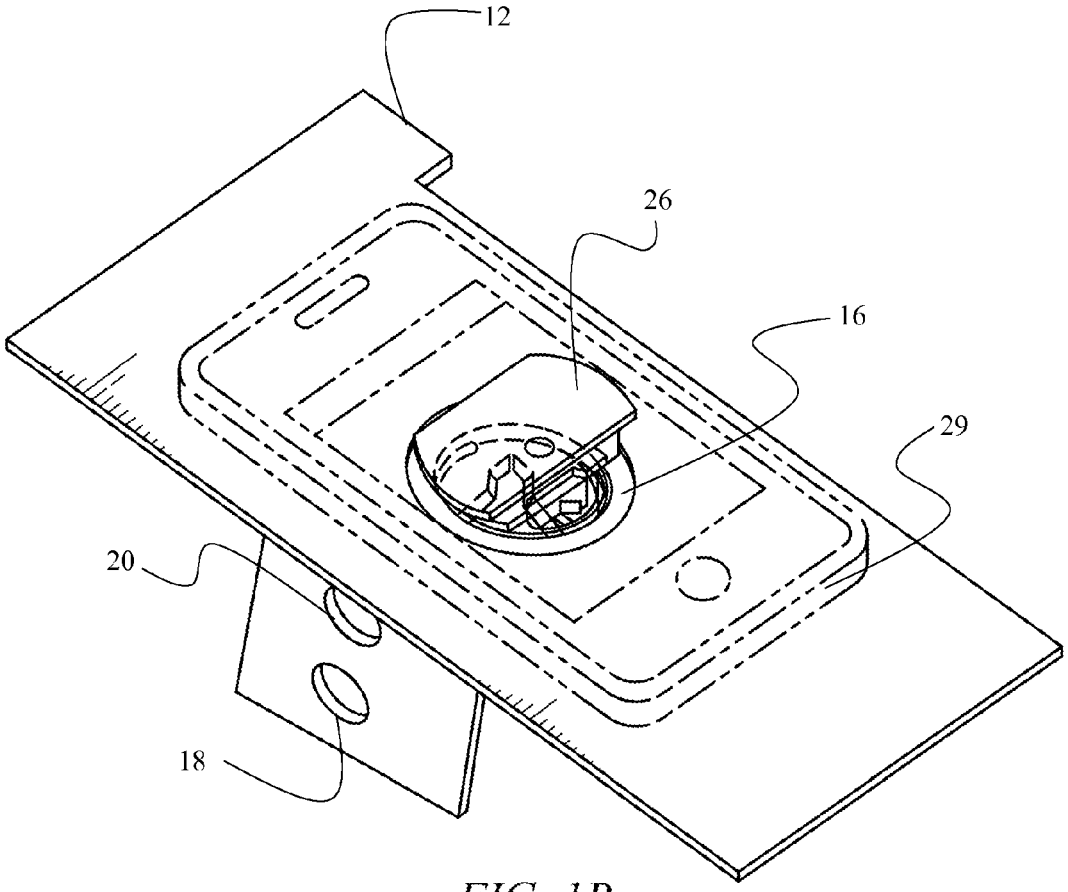
FIG. 1B is a perspective view of the display counter with the security sensor being locked within the anti-theft security base.

Referring to FIGS. 1A and 1B, the surface of a retail display counter 12 has an opening 14 adapted to align with the sensor receptacle 16 of an anti-theft device 10. Anti-theft device 10 is positioned underneath, or integrated into, display counter 12, where anti-theft device 10 is both discrete and inaccessible to unauthorized parties. This accomplishes a dual purpose: potential thieves cannot temper with the security mechanism, and anti-theft device 10 does not negatively affect the aesthetics of the retail store. FIGS. 1A-B also depict two keyholes 18 and 20, which are positioned underneath display counter 12 and, preferably, are accessible from a lateral surface thereof. Keyhole 18 is used for locking anti-theft device 10, while keyhole 20 is used for unlocking it.

Figure 2:
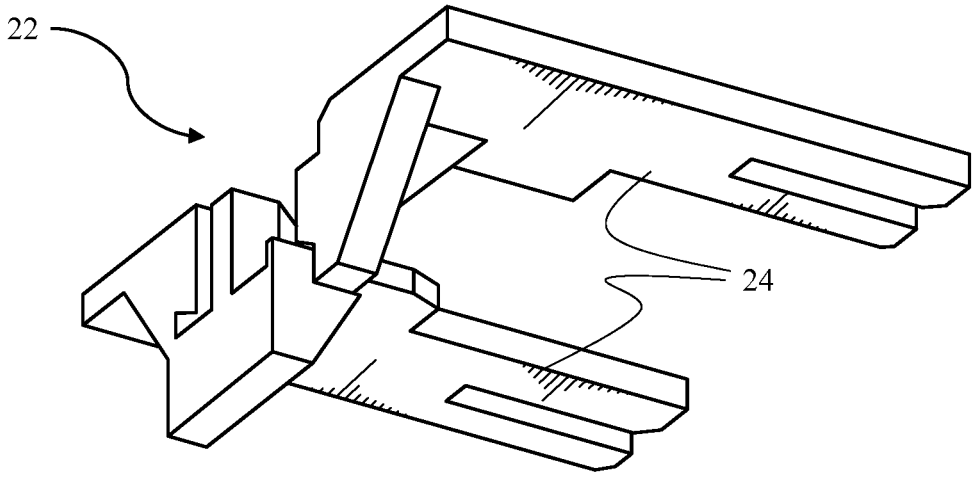
FIG. 2 is a perspective view of the locking clip.
Figure 3:
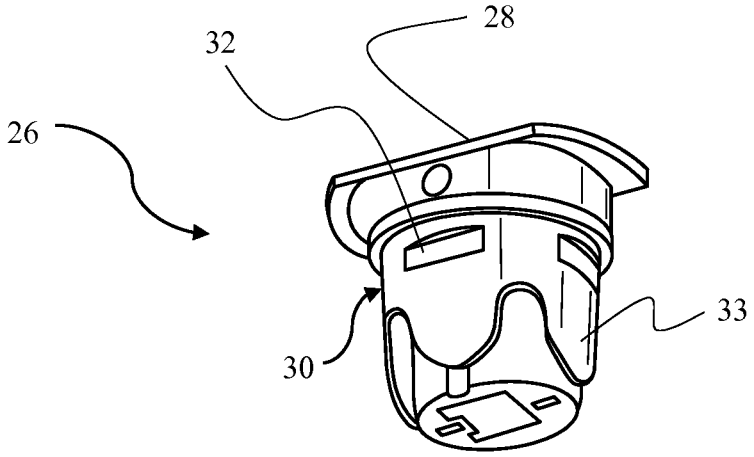
FIG. 3 is perspective view of the electronic security sensor.

FIG. 2 depicts a locking clip 22 having two outwardly extending fingers 24. FIG. 3 depicts a sensor 26 having a top surface 28 and a lateral surface 30. The top surface of sensor 26 fixedly attaches to a merchandise item 29. In the preferred embodiment, the attachment is accomplished via an adhesive layer 27. Numerous other means of attaching two surfaces to one another are known in the art and are within the scope of the present invention. Lateral surface 30 of sensor 26 contains slots 32 adapted to receive fingers 24 of clip 22. Slots 32 are disposed on opposite sides of sensor 26 and are simultaneously engaged by a pair of fingers 24. In an embodiment, two pairs of opposing slots 32 may be disposed on sensor 26, thereby allowing merchandise item 29 to be displayed in a landscape or portrait configurations without detaching sensor 26.

Figure 4:
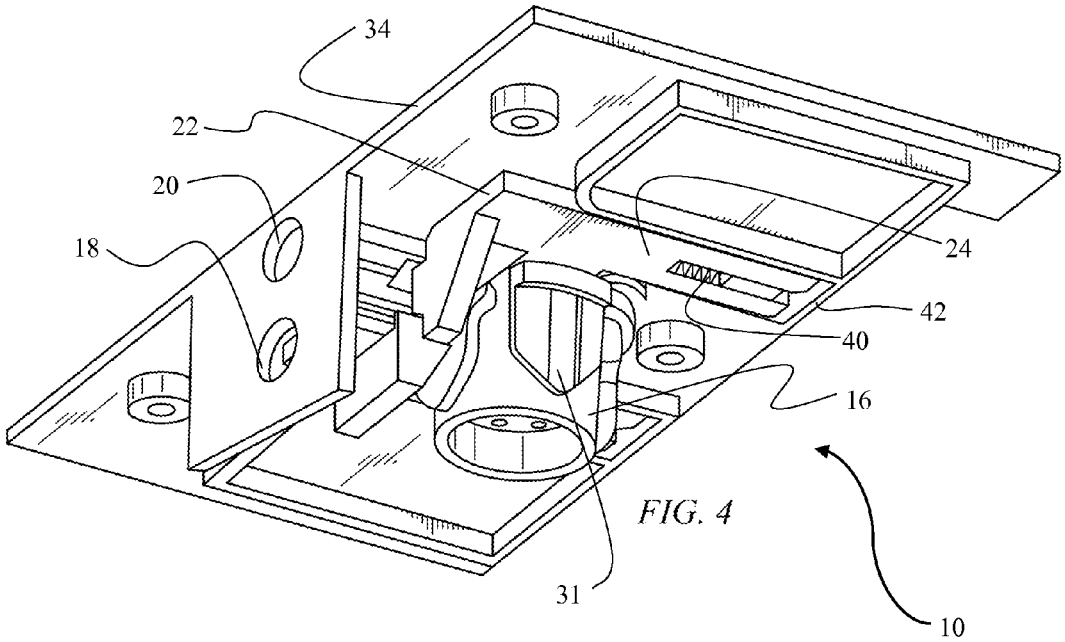
FIG. 4 is perspective view of the anti-theft device with the clip in its locked position.

FIG. 4 depicts an embodiment of the overall structure of anti-theft device 10. A base plate 34 contains a sensor receptacle 16 that is adapted to align with opening 14 of display counter 12. Sensor receptacle 16 is configured to receive sensor 26. Sensor receptacle 16 contains apertures 38, which align with slots 32 of sensor 26 when sensor 26 is positioned within sensor receptacle 16. To facilitate proper alignment, the inner surface of sensor receptacle 16 may contain one or more notches 31 adapted to receive protrusions 33 on lateral surface 30 of sensor 26. Notches 31 and protrusions 33 may have sloping edges thereby urging sensor 26 to slide into a proper alignment within sensor receptacle 16. Mating notches 31 and protrusions 33 further prevent sensor 26 from rotating within sensor receptacle 16. Other types of mating surfaces are also within the scope of the invention.

Continuing reference to FIG. 4, clip 22 is in a sliding engagement with base plate 34: clip 22 slides longitudinally toward sensor receptacle 16 and away therefrom. Clip 22 may be biased away from sensor receptacle 16 by a biasing element 40, such as a helical compression spring, a helical tension spring, a plastic biasing device forming a part of clip 22, and other biasing means known in the art. In an embodiment, base plate 34 may contain channels 42 configured to guide the sliding motion of clip 22 in a longitudinal direction by restricting its lateral movement. In an embodiment, the distal ends of clip 22 may contain elongated stems adapted to receive biasing elements 40.

Figure 5A:
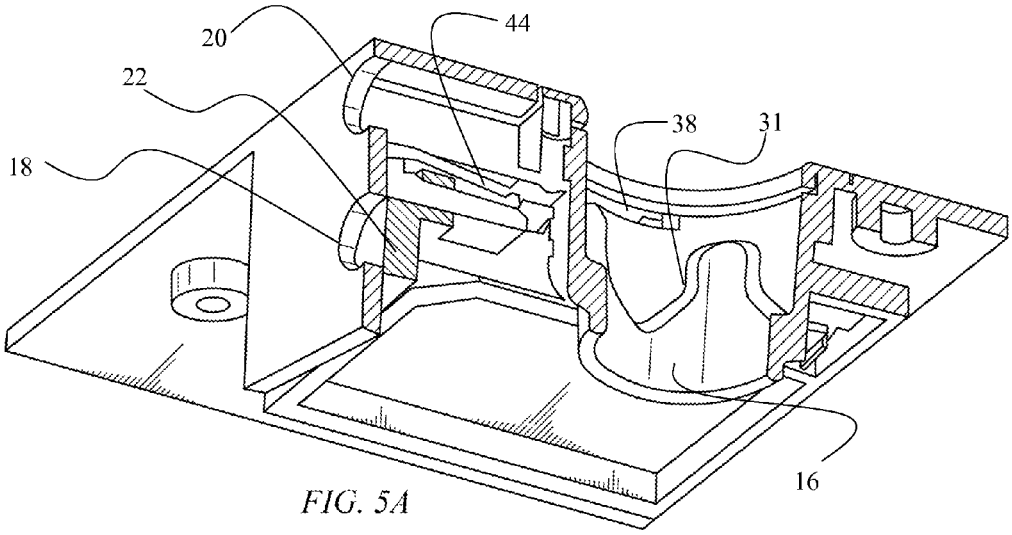
FIG. 5A is a perspective cross-sectional view of the anti-theft device with the clip in its unlocked position.
Figure 5B:
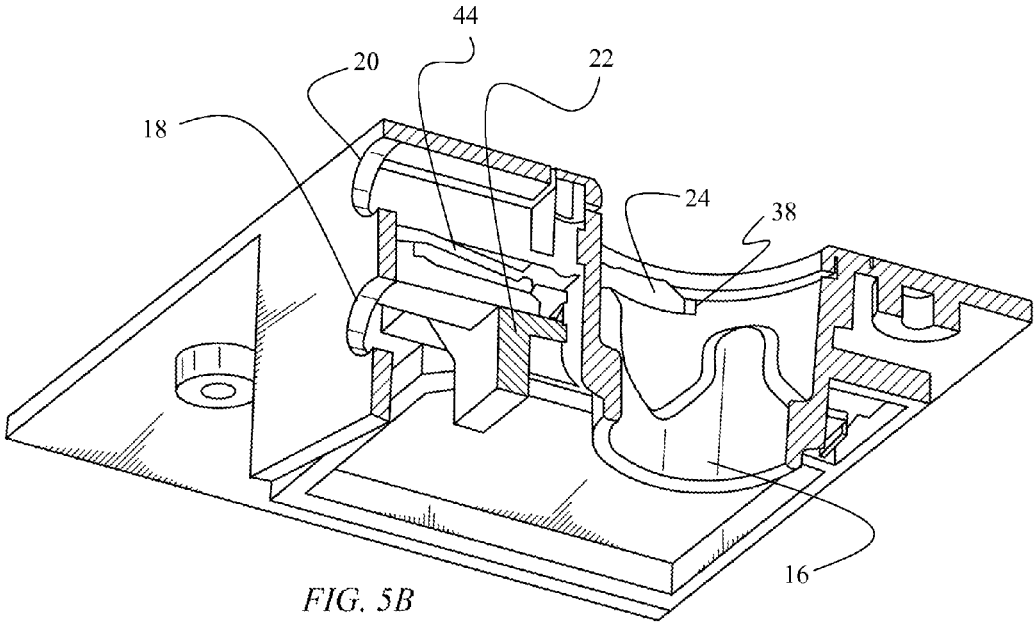
FIG. 5B is a perspective cross-sectional view of the anti-theft device with the clip in its locked position.

As shown in FIG. 2, fingers 24 of clip 22 are configured to slide into apertures 38 of sensor receptacle 16. When sensor 26 is placed inside sensor receptacle 16, slots 32 align with apertures 38 allowing fingers 24 to slide through apertures 38 and enter slots 32. As depicted in FIG. 5B, when clip 22 is in its locked position, fingers 24 of clip 22 protrude through apertures 38 of sensor receptacle 16 and engage slots 32 of sensor 26, thereby securing sensor 26 within sensor receptacle 16.

FIGS. 5A-B, 6A-B and 7A-B depict a locking mechanism and demonstrate the method of locking and unlocking anti-theft device 10 through a series of sequential figures. Locking mechanism comprises a locking member 44, the proximal end of which may be pivotally attached to base plate 34. Either the entire locking member 44, or at least its free distal end, must be magnetic. In an alternative embodiment, locking mechanism may reside on clip 22 rather than on base plate 34.

Figure 6A:
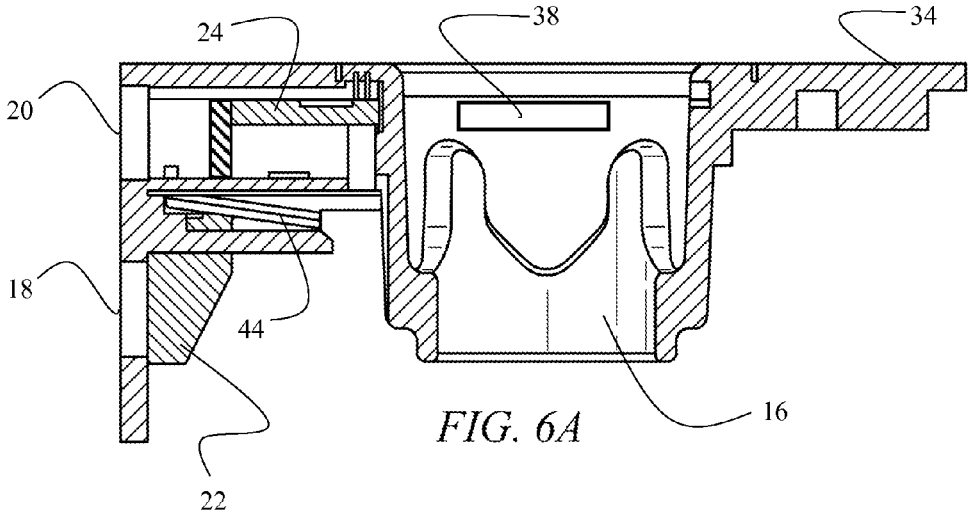
FIG. 6A is a cross-sectional side view of the anti-theft device with the clip in the unlocked position.
Figure 6B:
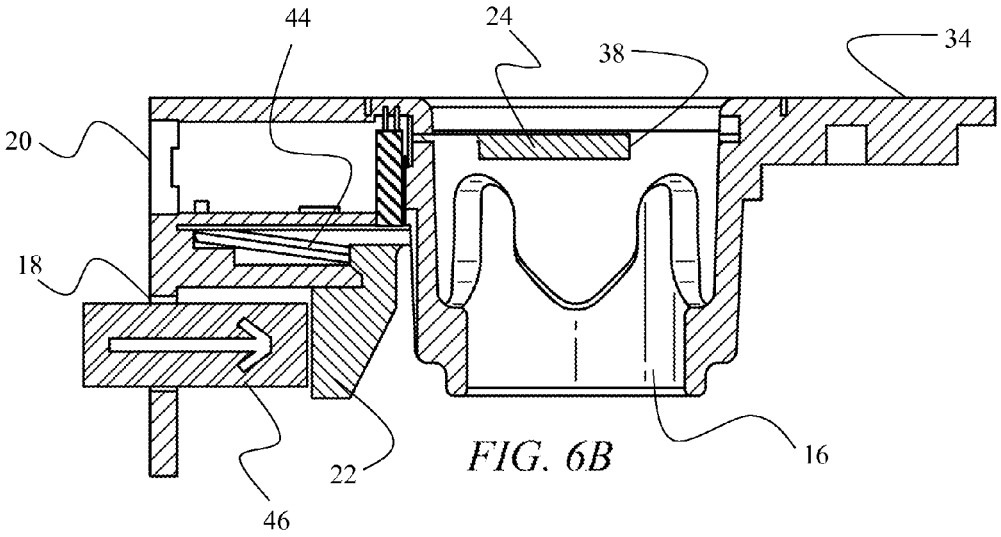
FIG. 6B is a cross-sectional side view of the anti-theft device with the key pushing the clip toward its locked position.

FIGS. 6A-B illustrate operation of anti-theft device 10. FIG. 6A shows anti-theft device 10 in its unlocked configuration with clip 22 retracted away from sensor receptacle 16. A semi-specialized dipole magnet key 46 is required to lock and unlock anti-theft device 10. Key 46 must have a cross-sectional shape corresponding to the shape of keyholes 18 and 20 to permit insertion of key 46. To lock sensor 26 within sensor receptacle 16, sensor 26 is first positioned within sensor receptacle 16, so that slots 32 are in alignment with apertures 38.

Referring to FIG. 6B, key 46 is inserted into keyhole 18, whereby the distal end of key 46 engages the back surface of clip 22. As key 46 is inserted farther forward into keyhole 18, key 46 pushes clip 22 toward sensor receptacle 16 against the force exerted on clip 22 by biasing element 40. As clip 22 slides forward, it causes the free end of locking member 44 to pivot upwards. The free end of locking member 44 is urged downwards by the magnetic field of key 46 and gravity. Once clip 22 slides a distance exceeding the length of locking member 44, the free end of locking member 44 pivots downward toward magnet key 46. At this point, locking member 44 engages the back surface of clip 22 preventing its backward movement as shown in FIG. 6B. In this locked configuration, fingers 24 of clip 22 protrude through apertures 38 of sensor receptacle 16 and engage slots 32 of sensor 26, thereby securing sensor 26 within sensor receptacle 16. Locking member 44 retains clip 22 in this locked configuration by preventing it from retracting away from sensor receptacle 16. Clip 22 may contain a groove adapted to receive locking member 44. This feature further ensures that locking member 44 does not accidentally disengage clip 22.

Figure 7A:
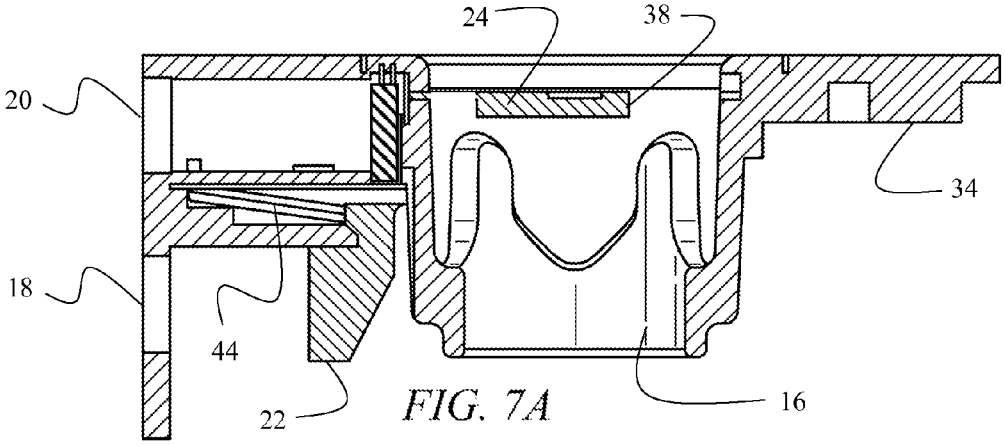
FIG. 7A is a cross-sectional side view of the anti-theft device depicting the clip in its locked position.
Figure 7B:
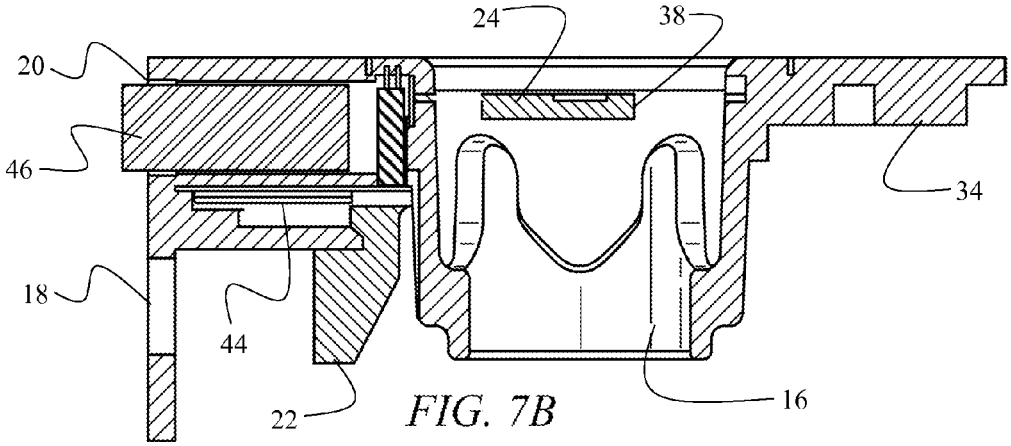
FIG. 7B is a cross-sectional side view of the anti-theft device depicting the magnet key attracting the locking member to disengage it from the clip.
Figure 7C:
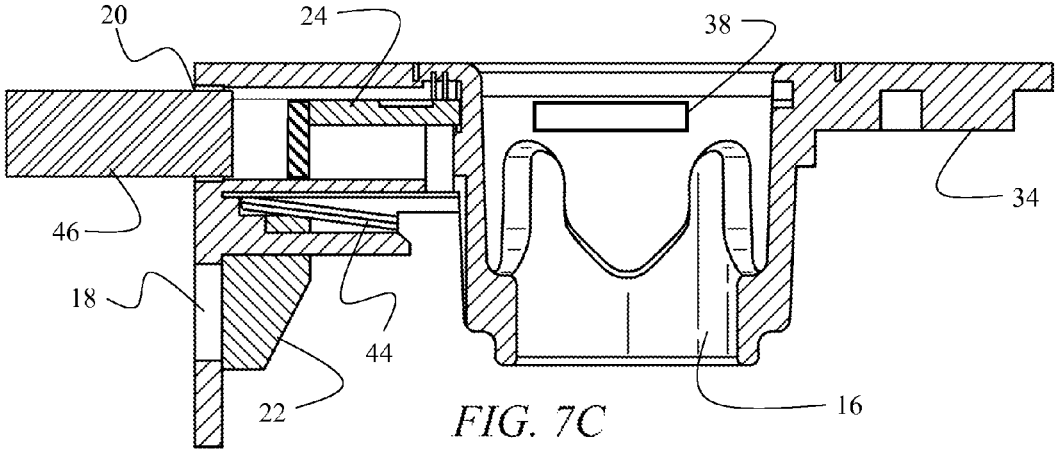
FIG. 7C is a cross-sectional side view of the anti-theft device depicting the clip being retracted into its unlocked positing as the magnet key is being removed.

FIGS. 7A-B illustrate the method of unlocking anti-theft device 10. FIG. 7A depicts anti-theft device 10 in its locked configuration. FIG. 7B shows key 46 being inserted into the keyhole 20, where key 46 engages the upper portion of clip 22 and pushes clip 22 away from locking member 44—this releases locking member 44 from clip 22. The magnetic force of the dipole magnet, which forms the body of key 46, urges the free end of locking member 44 upwards, thereby retracting locking member 44 away from clip 22. As discussed above, clip 22 is continuously urged toward the unlocked position by biasing element 40. Therefore, when key 46 is removed from keyhole 20, as shown in FIG. 7C, clip 22 retracts backwards into its unlocked position. In this configuration, fingers 24 of clip 22 are retracted away from apertures 38, thereby exiting slots 32 of sensor 26. This releases sensor 26 from sensor receptacle 16.

When anti-theft device 10 is in its unlocked configuration, merchandise item 29 attached to sensor 26 may be removed from the display counter to allow the consumers to interact with it. Even when merchandise item 29 is out of anti-theft device 10, electronic sensor 26 remains attached to merchandise item 29 and monitors against unauthorized removal thereof from the store. After the interaction is over, store personnel places merchandise item 29 back into anti-theft device 10 and locks it in place according to the steps described above.

In alternative embodiments, locking member 44 may be biased toward a locked configuration via a separate biasing element or, preferably, through the shape of locking member 44 itself. The free end of locking member 44 may be curved, and, provided that the displacement of the free end of locking member 44 during transitioning between locked and unlocked configurations does not exceed the modulus of elasticity of the material from which locking member 44 is made, the elastic deformation of locking member 44 will return its free end downward toward the locked position when the free end is not urged upwards by the magnetic field of key 46.

In other embodiments, locking member 44 may be a strip, a tine, a shuttle, a bayonet, or a similar component. A person of ordinary skill in the art will appreciate that locking member 44 need not be pivotally attached to base plate 34 and, instead, may be disposed in a cavity allowing locking member 44 to move up and down responsive to insertion of key 46 either in keyhole 18 or keyhole 20.

Figure 8A:
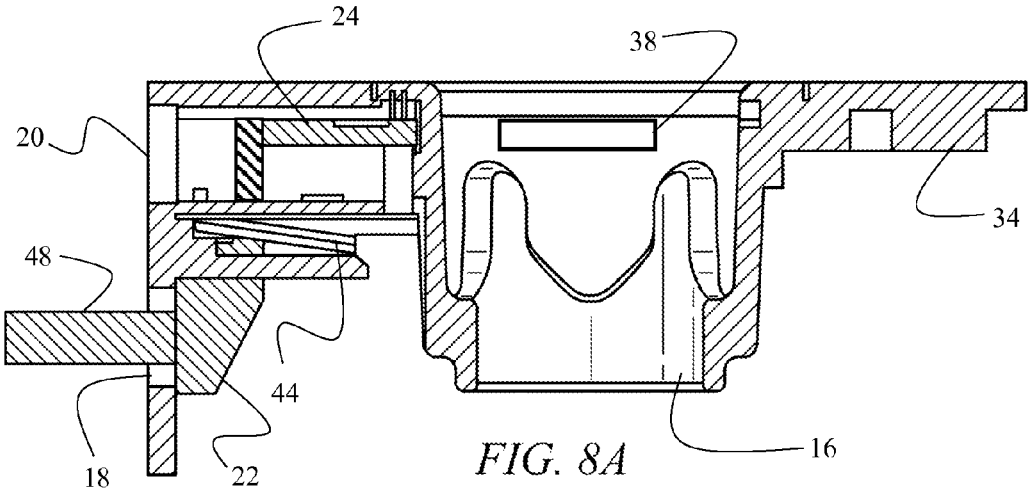
FIG. 8A is a cross-sectional side view of the alternative embodiment of the anti-theft device with the clip having a protruding end, where the clip is in the unlocked position.
Figure 8B:
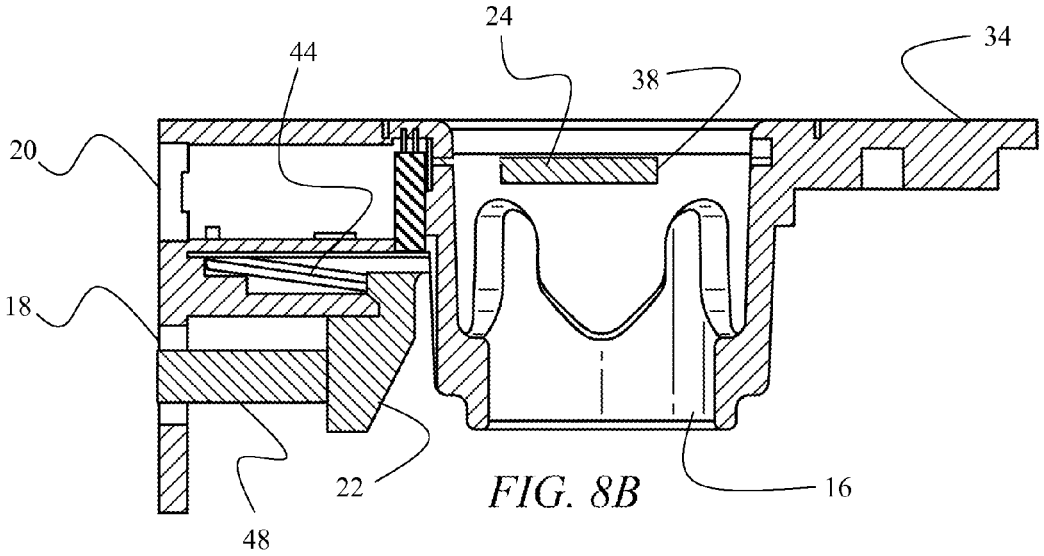
FIG. 8B is a cross-sectional side view of the alternative embodiment of the anti-theft device with the clip having a protruding end, where the clip is in the locked position.

An alternative embodiment of anti-theft device is depicted in FIGS. 8A-B. Clip 22 further includes a protruding end 48, which extends outside keyhole 20, forming a button-like feature depicted in FIG. 8A. To lock the device, the user pushes in protruding end 48. This causes clip 22 to slide into its locked position where locking member 44 engages clip 22 and prevents it from retracting, as shown in FIG. 8B. This embodiment eliminates the need for key 46 for transitioning anti-theft device 10 from an unlocked to locked configuration. In this embodiment, locking member 44 must be urged toward the locked position (this may be accomplished by various known means including a spring, a biasing strip, gravity, shape of locking member 44, etc.). To unlock anti-theft device 10, key 46 is inserted into keyhole 18. The magnetic force exerted on locking member 44 by key 46 disengages locking member 44 from clip 22, thereby releasing clip 22 and allowing it to retract to the unlocked configuration shown in FIG. 8A.

Some potential benefits of this embodiment include the following: 1) key 46 is not required to lock anti-theft device 10; 2) the operation and design of anti-theft are more intuitive requiring the protruding end 48 to be pushed in to lock anti-theft device, much like a conventional mechanical button, 10; 3) it is easy to visually verify whether sensor 26 is locked: if protruding end 48 is pushed in, anti-theft device 10 is locked, if protruding end 48 extends out, anti-theft device 10 is unlocked; 4) simplified locking and unlocking procedure: since there is only one keyhole 18, the user cannot mistakenly insert key 46 into wrong keyhole when trying to lock or unlock the device.

The advantages set forth above, and those made apparent from the foregoing description, are efficiently attained. Since certain changes may be made in the above construction without departing from the scope of the invention, it is intended that all matters contained in the foregoing description or shown in the accompanying drawings shall be interpreted as illustrative and not in a limiting sense.

GLOSSARY OF TERMS

Adhesive layer—a layer of a substance disposed between the top surface of the electronic sensor and the merchandise item used to affix the sensor to the item.

Aperture—an opening disposed on the sensor receptacle that allows the clip to enter the hollow interior space of the sensor receptacle. When the sensor is inserted into the sensor receptacle, the apertures of the sensor receptacle and the slots of the sensor align, thereby allowing the clip to pass through the aperture and enter the slots of the sensor.

Base plate—a structure on which other components of the anti-theft device reside.

Biasing element—a mechanical component used to store mechanical energy and exert a force in response to being compressed, extended, bent, or otherwise elastically deformed. A biasing element may be a helical coil spring, a rubber element, a rigid element under an elastic deformation, or other such components known in the art.

Clip—a sliding component of anti-theft device that engages the slots of the electronic sensor to secure the electronic sensor within the sensor receptacle.

Electronic sensor—a sensor containing electrical components and circuitry configured to detect unauthorized tempering with or removal of the merchandise item to which the sensor is fixedly attached.

Finger—a longitudinally extending subpart of the clip adapted to protrude through an aperture on the sensor receptacle and engage a slot of the sensor when the clip is in the locked position.

Keyhole—an opening adapted to receive a key. The outer geometry of the key must match the inner geometry of the keyhole in order to permit insertion of the key into the keyhole.

Locked position—a position in which the clip passes through the aperture of the sensor receptacle and engages the slot of the sensor, thereby retaining the sensor within the sensor receptacle.

Locking member—a component that engages the clip when the clip is in the locked position, thereby preventing the clip from sliding into an unlocked position.

Magnet key—an component having an elongated body comprising a dipole magnet. The magnet key must exhibit a magnetic field sufficient to produce a force necessary to displace the locking member.

Mating elements—complementary protrusions, notches, grooves, or other elements that form irregularities on the inner surface of the sensor receptacle and lateral surface of the sensor. The mating elements are configured to facilitate proper alignment of the sensor within the sensor receptacle and prevent rotation of the sensor within the receptacle.

Protruding end—a subcomponent of the clip that protrudes beyond the keyhole when the clip is in the locked configuration. Application of longitudinal force to the protruding end slides the clip toward its locked position. When the clip is in the locked position the protruding end does not extend beyond the keyhole.

Sensor receptacle—a structure with a hollow interior space adapted to receive an electronic sensor.

Slot—an elongated notch or slit disposed on the sensor and adapted to receive the clip.

Unlocked position—a position of the clip in which the clip is retracted away from the sensor receptacle and the sensor is not secured within the receptacle. The clip is preferably biased toward the unlocked position.

What is claimed is:

1. An anti-theft device for displayed merchandise, comprising:

a base plate;

a sensor receptacle disposed on the base plate;

an electronic sensor receivable within the sensor receptacle;

a clip slidingly disposed on the base plate, the clip being slidable between a locked position and an unlocked position, wherein the clip secures the sensor within the sensor receptacle when the clip is in the locked position;

a locking member disposed between the clip and the base plate, the locking member engaging the clip when the clip is in the locked position, thereby preventing the clip from retracting to the unlocked position;

a groove disposed on the clip for receiving the locking member when the clip is in the locked position; and a magnet key configured to disengage the locking member from the clip allowing the clip to retract to the unlocked position, thereby releasing the sensor from the sensor receptacle.

2. The anti-theft device according to claim 1, further comprising:

an aperture disposed on the sensor receptacle; and a slot disposed on a lateral surface of the sensor;

wherein, in the locked position, the clip protrudes through the aperture of the sensor receptacle and enters the slot on the sensor, thereby retaining the sensor within the sensor receptacle.

3. The anti-theft device according to claim 1, further comprising a biasing element urging the clip toward the unlocked position.

4. The anti-theft device according to claim 1, further comprising an adhesive layer disposed on a top surface of the sensor for fixedly attaching the sensor to a merchandise item.

5. The anti-theft device according to claim 1, wherein the locking member is biased toward a position where the locking member engages the clip.

6. The anti-theft device according to claim 5, wherein the magnet key is configured to overcome biasing force acting on the locking member to disengage the locking member from the clip.

7. The anti-theft device according to claim 1, further comprising one or more keyholes disposed on the base plate for receiving the magnet key.

8. The anti-theft device according to claim 1, further comprising a channel disposed on the base plate for guiding the clip as the clip slides between the locked position and the unlocked position.

9. The anti-theft device according to claim 1, further comprising a protruding end disposed on a proximal surface of the clip, the protruding end extending beyond the base plate when the clip is in the unlocked position, wherein transitioning of the clip from the unlocked position to the locked position is accomplished by applying a longitudinal force to the protruding end.

10. The anti-theft device according to claim 1, further comprising a plurality of complimentary mating elements disposed on a lateral surface of the sensor and an inner surface of the sensor receptacle, whereby the complimentary mating elements facilitate proper alignment of the sensor within the sensor receptacle.

11. An anti-theft device for displayed merchandise, comprising:

a base plate;

a sensor receptacle integrated into the base plate;

an electronic sensor having a top surface and a lateral surface, the top surface configured to fixedly attach to a merchandise item, the lateral surface configured to mate with an inner surface of the sensor receptacle;

an aperture disposed on the sensor receptacle;

a slot disposed on the lateral surface of the sensor, wherein the aperture of the sensor receptacle and the slot of the sensor are aligned when the sensor is received within the sensor receptacle;

a clip in a sliding engagement with the base plate, the clip being slidable between a locked position and an unlocked position, the clip having one or more fingers configured to protrude through the aperture of the sensor receptacle and enter the slot of the sensor to retain the sensor within the sensor receptacle when the clip is in the locked position;

a locking member for retaining the clip in the locked position by engaging the clip, wherein the locking member prevents the clip from retracting to the unlocked position; and a magnet key configured to disengage the locking member from the clip allowing the clip to retract to the unlocked position, thereby releasing the sensor from the sensor receptacle.

12. The anti-theft device according to claim 11, further comprising a biasing element urging the clip toward the unlocked position.

13. The anti-theft device according to claim 11, wherein the locking member is biased toward a position where the locking member engages the clip.

14. The anti-theft device according to claim 13, wherein the magnet key is configured to overcome biasing force acting on the locking member to disengage the locking member from the clip.

15. The anti-theft device according to claim 11, further comprising one or more keyholes disposed on the base plate for receiving the magnet key.

16. The anti-theft device according to claim 11, further comprising a channel disposed on the base plate for guiding the clip as the clip slides between the locked and the unlocked positions.

17. The anti-theft device according to claim 11, further comprising a groove disposed on the clip for receiving the locking member when the clip is in the locked position.

18. The anti-theft device according to claim 11, further comprising a protruding end disposed on a proximal surface of the clip, the protruding end extending beyond the base plate when the clip is in the unlocked position, wherein transitioning of the clip from the unlocked position to the locked position is accomplished by applying a longitudinal force to the protruding end.

19. The anti-theft device according to claim 11, further comprising a plurality of complimentary mating elements disposed on a lateral surface of the sensor and an inner surface of the sensor receptacle, whereby the complimentary mating elements facilitate proper alignment of the sensor within the sensor receptacle.

20. An anti-theft device for displayed merchandise, comprising:

a base plate;

a sensor receptacle disposed on the base plate;

an electronic sensor receivable within the sensor receptacle;

a plurality of complimentary mating elements disposed on a lateral surface of the sensor and an inner surface of the sensor receptacle, whereby the complimentary mating elements facilitate proper alignment of the sensor within the sensor receptacle;

a clip slidingly disposed on the base plate, the clip being slidable between a locked position and an unlocked position, wherein the clip secures the sensor within the sensor receptacle when the clip is in the locked position;

a locking member disposed between the clip and the base plate, the locking member engaging the clip when the clip is in the locked position, thereby preventing the clip from retracting to the unlocked position; and a magnet key configured to disengage the locking member from the clip allowing the clip to retract to the unlocked position, thereby releasing the sensor from the sensor receptacle.

21. The anti-theft device according to claim 20, further comprising:

an aperture disposed on the sensor receptacle; and a slot disposed on a lateral surface of the sensor;

wherein, in the locked position, the clip protrudes through the aperture of the sensor receptacle and enters the slot on the sensor, thereby retaining the sensor within the sensor receptacle.

22. The anti-theft device according to claim 20, further comprising a biasing element urging the clip toward the unlocked position.

23. The anti-theft device according to claim 20, further comprising an adhesive layer disposed on a top surface of the sensor for fixedly attaching the sensor to a merchandise item.

24. The anti-theft device according to claim 20, wherein the locking member is biased toward a position where the locking member engages the clip.

25. The anti-theft device according to claim 24, wherein the magnet key is configured to overcome biasing force acting on the locking member to disengage the locking member from the clip.

26. The anti-theft device according to claim 20, further comprising one or more keyholes disposed on the base plate for receiving the magnet key.

27. The anti-theft device according to claim 20, further comprising a channel disposed on the base plate for guiding the clip as the clip slides between the locked position and the unlocked position.

28. The anti-theft device according to claim 20, further comprising a groove disposed on the clip for receiving the locking member when the clip is in the locked position.

29. The anti-theft device according to claim 20, further comprising a protruding end disposed on a proximal surface of the clip, the protruding end extending beyond the base plate when the clip is in the unlocked position, wherein transitioning of the clip from the unlocked position to the locked position is accomplished by applying a longitudinal force to the protruding end.

* * * * *